US007342540B2

(12) United States Patent
Nahar et al.

(10) Patent No.: US 7,342,540 B2
(45) Date of Patent: Mar. 11, 2008

(54) DUAL BAND DIVERSITY WLAN ANTENNA SYSTEM FOR LAPTOP COMPUTERS, PRINTERS AND SIMILAR DEVICES

(75) Inventors: Vijay Nahar, Cambridge (GB); Brian Collins, Cambridge (GB)

(73) Assignee: Antenova Ltd., Cambridge (GB)

( * ) Notice: Subject to any disclaimer, the term of this patent is extended or adjusted under 35 U.S.C. 154(b) by 34 days.

(21) Appl. No.: 10/586,155

(22) PCT Filed: Jan. 14, 2005

(86) PCT No.: PCT/GB2005/000105

§ 371 (c)(1),
(2), (4) Date: Jul. 14, 2006

(87) PCT Pub. No.: WO2005/069433

PCT Pub. Date: Jul. 28, 2005

(65) Prior Publication Data

US 2007/0164904 A1 Jul. 19, 2007

(30) Foreign Application Priority Data

Jan. 16, 2004 (GB) ..... 0400925.4

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS

| | | | | |
|---|---|---|---|---|
| 6,535,170 | B2 * | 3/2003 | Sawamura et al. | ..... 343/702 |
| 2003/0043075 | A1 | 3/2003 | Bit-Babik et al. | |
| 2003/0132883 | A1 | 7/2003 | Wong et al. | |

FOREIGN PATENT DOCUMENTS

| | | |
|---|---|---|
| EP | 0 604 338 | 6/1994 |
| EP | 0 801436 | 10/1997 |

(Continued)

OTHER PUBLICATIONS

K. Lan et al.: "Antennas and Propagation International Symposium", IEEE, pp. 926-929, Jun. 2003, vol. 2.

(Continued)

*Primary Examiner*—Hoang V. Nguyen
(74) *Attorney, Agent, or Firm*—Pearl Cohen Zedek Latzer, LLP

(57) ABSTRACT

There is disclosed a dual band antenna device including a dielectric substrate (6) having opposed first and second surfaces and a groundplane (7) on the second surface. A microstrip transmission line (4) is provided on the first surface, and a dielectric pellet (5) is mounted on the first surface on the microstrip transmission line (4). A bifurcated planar inverted-L antenna (PILA) component (1) is also mounted on the first surface, the PILA component (1) having first (2) and second (3) arms which extend over and contact a surface of the dielectric pellet (5). The first arm (3) contacts a different area of the surface of the dielectric pellet (5) than the second arm (2). The antenna device provides good operation at both 2.4 GHz and 5.5 GHz frequency bands.

7 Claims, 4 Drawing Sheets

FOREIGN PATENT DOCUMENTS

| | | |
|---|---|---|
| EP | 1 146 589 | 10/2001 |
| EP | 1 249 888 | 10/2002 |
| EP | 1 418 644 | 5/2004 |
| GB | 2403069 | 12/2004 |

OTHER PUBLICATIONS

Z.N. Chen et al: "Broadband planar inverted-L antennas", IEEE Proc. Microw. Antennas Propag., Oct. 2001, vol. 148, No. 5.

International Search Report of Application No. PCT/GB2005/000105 dated May 17, 2005.

GB Search Report of Application No. GB0400925.4 dated May 27, 2004.

GB Search Report of Application No. GB0500644.0 dated Apr. 29, 2005.

IEEE Antennas and Propagation Society International Symposium; Jun. 22-27, 2003; Columbus, Ohio; vol. 2; 2003 Digest; pp. X,1,51,101,151-152,201-202, 251, 301, 351-352, 401-402, 443, 493-494, 543-544, 593,619, 645-646, 691, 741, 791-792, 837-838, 867,917, 967,993-994, 1003-1004, 1053-1054, 1085-1086, 1123, 1133, 1155-1156.

* cited by examiner

DUAL BAND DIVERSITY WLAN ANTENNA SYSTEM FOR LAPTOP COMPUTERS, PRINTERS AND SIMILAR DEVICES

PRIOR APPLICATION DATA

The present application is a national phase application of International Application PCT/GB2005/000105, entitled "A DUAL BAND DiVERSITY WLAN ANTENNA SYSTEM FOR LAPTOP COMPUTERS, PRINTERS AND SIMILAR DEVICES" filed on Jan. 14, 2005, which in turn claims priority from GB application number 0400925.4, filed on Jan. 16, 2004, all of which are incorporated by reference in their entirety.

FIELD OF THE INVENTION

The present invention relates to a novel antenna, which may cover the frequency bands used for IEEE802.11a/b/g wireless LANS, comprising a dual-band radiator coupled to a microstrip transmission line by means of shaped ceramit pellet.The device is designed to be fitted into the display section of laptop computers,but may also find applications in devices that communicate with computers such as printers, and the like. The devices are desined to operate in pairs with good isolation between them, so as to creat diversity in the antenna system.

BACKGROUND OF THE INVENTION

The introduction of wireless LAN connectivity has created a demand for compact low-cost antennas covering the frequency bands 2.4-2.5 GHz and 4.9-5.9 GHz. These are typically fitted to laptop computers and PDAs, and they will soon be found in printers, scanners and other peripheral devices.

The essential properties for these antennas are high efficiency, and radiation patterns which are as nearly omnidirectional as possible—even when mounted on the target device. These electrical parameters must be combined with physically small dimensions and the potential for production at very low cost. Most antennas will be directly connected to a sub-miniature coaxial cable and the antenna design must embody a suitable means of attachment that will control the placement of the cable accurately enough to ensure good repeatability of input matching.

SUMMARY

According to a first aspect of the present invention, there is provided a dual band antenna device comprising a dielectric substrate having opposed first and second surfaces, a groundplane on the second surface, a microstrip transmission line on the first surface, a dielectric pellet mounted on the first surface on the microstrip transmission line, and a bifurcated planar inverted-L antenna (PILA) component mounted on the first surface, the PILA component having first and second electrically connected arms which extend over and contact a surface of the dielectric pellet, the first arm contacting a different area of the surface of the dielectric pellet than the second aim, the PILA also being electrically connected to the groundplane.

The dielectric substrate may be in the form of a printed circuit board (PCB) with a metallised (e.g. copper) groundplane. A particularly preferred dielectric substrate is a Duroid® PCB.

The dielectric pellet is preferably made of a high permittivity ceramics material, for example having a relative permittivity of at least 6.

The dielectric pellet is preferably an elongate oblong with a generally flat upper surface (i.e. the surface of the pellet distal from the first surface of the dielectric substrate), and in a particularly preferred embodiment is formed as a bridge structure such that it contacts the microstrip transmission line only at its ends.

The bifurcated PILA is preferably arranged substantially in line with the elongate ceramic pellet, and the first arm of the PILA preferably extends across and contacts an entire length of the upper surface of the ceramic pellet, while the second arm of the PILA is preferably shorter than the first arm and contacts only one small part of the upper surface of the ceramic pellet. An end of the PILA distal from the arms may be connected to the groundplane by way of conductive pins that pass through the dielectric substrate.

In contrast to traditional dielectric resonator antenna (DRA) structures, where the ceramic pellet (the resonator) is fed at a single point (e.g. by a probe or slot feed), the ceramic pellet in the present invention is fed along its length where it contacts the microstrip transmission line. The ceramic pellet does not itself radiate significantly, but serves as a dielectric load for the arms of the PILA, which is the main radiating structure.

At lower frequency bands, e.g. 2.4 GHz, the first, longer arm of the PILA tends to be the main radiator, and is excited by the electromagnetic field in a corner of the ceramic pellet near the end of the first arm.

At higher frequency bands, e.g. 5.5 GHz, the second, shorter arm of the PILA tends to be the main radiator, and is excited by the electromagnetic field in a corner of the ceramic pellet near the end of the second arm.

Nevertheless, it is to be appreciated that the whole of the ceramic pellet can excite the PILA to a greater or lesser extent depending on the frequency and also on specific design factors.

By exciting the two arms of the PILA in different ways, the present invention provides a novel dual band hybrid antenna.

In an alternative embodiment, the dielectric substrate beneath the ceramic pellet can be removed so as to leave the pellet suspended from the PILA over the groundplane, and the microstrip transmission line omitted. In this embodiment, the pellet is fed directly by a coaxial cable with its outer element connected to ground and its inner element soldered or otherwise connected to the pellet.

Accordingly, in a second aspect, the present invention provides a dual band antenna device comprising a dielectric substrate having opposed first and second surfaces, a groundplane on the second surface, a bifurcated planar inverted-L antenna (PILA) component mounted on the first surface and electrically connected to the groundplane, the PILA component having first and second electrically connected arms, and a dielectric pellet having a surface connected to the first and second arms, wherein the dielectric substrate includes an aperture that is disposed beneath the dielectric pellet, wherein the pellet is connected to a coaxial feed line, and wherein the first arm of the PILA component contacts a different area of the surface of the dielectric pellet than the second arm, the PILA also being electrically connected to the groundplane.

BRIEF DESCRIPTION OF THE DRAWINGS

For a better understanding of the present invention and to show how it may be carried into effect, reference shall now be made by way of example to the accompanying drawings, in which.

DETAILED DESCRIPTION OF THE INVENTION

Figure 1:
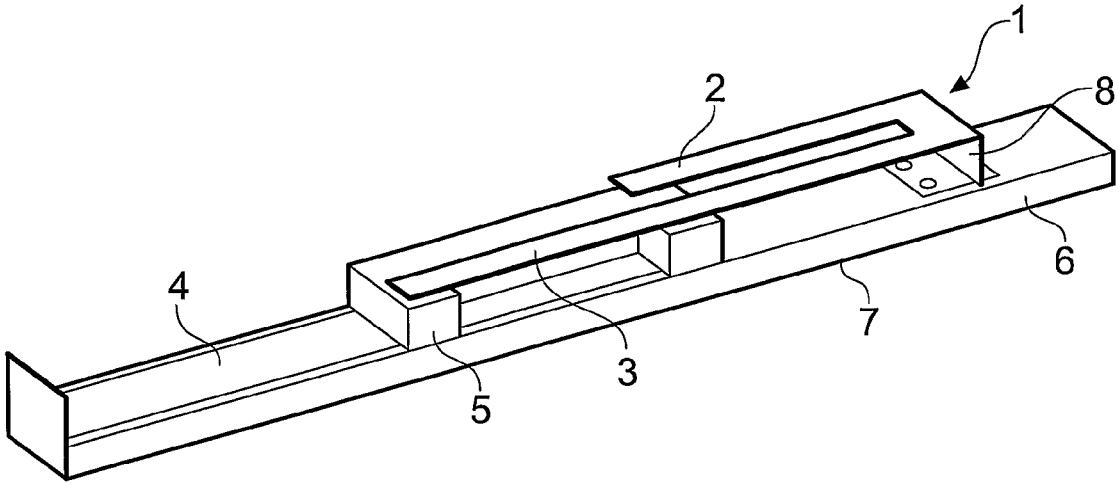
FIG. 1 shows a preferred embodiment of the present invention.

In a particular example, shown in FIG. 1, the antenna comprises three major components:

Radiating element 1: This is a narrow quarter-wavelength grounded patch with separate radiators 2, 3 for each frequency band.

Microstrip feed line 4: The radiating elements 1, 2, 3 are excited from a microstrip feedline 4 entering the structure at the open-circuit end. The feedline 4 incorporates a matched microstrip/coaxial transition to allow the antenna to be fed from a subminiature coaxial cable (1.2 mm diameter) (not shown).

Ceramic pellet 5: The shaped ceramic pellet 5 ($\in r=6$ in this example) loads the radiating element 1, reducing its physical length, and also enhances the coupling between the element 1 and the feedline 4.

The radiating element 1, microstrip feed line 4 and ceramic pellet 5 are all mounted on one side of a dielectric substrate 6, which is preferably made of Duroid®. The opposed side of the substrate 6 is provided with a conductive groundplane 7.

A leg portion 8 of the radiating element 1 is shorted to the groundplane 7 by way of a conductive connection through the dielectric substrate 6.

The ceramic component 5 is not functioning as a dielectric resonator antenna (DRA), yet the operation of the structure is strongly dependent upon its presence for reasons beyond simple dielectric loading; for this reason it is referred to as a hybrid ceramic antenna.

The radiating element 1 is not a PIFA (a planar inverted-F antenna) with a fixed feed point tapped into the patch or closely capacitively coupled into the patch, as is usual practice for engineering small patch antennas. In contrast, the element 1 is a PILA (a planar inverted-L antenna) and has no direct feed point. Instead it is excited by the electromagnetic field in a relatively long dielectric ceramic pellet 5, which is in turn fed by the microstrip transmission line 4. The field in the ceramic pellet 5 is generated by displacement currents. The arrangement provides a number of additional parameters, such as the shape, dimensions and relative permittivity of the ceramic 5, and its position relative to both the microstrip line 5 and the radiating element 1. The optimisation of these parameters allows the designer substantial choice in the performance of the antenna, as can be seen by the example.

The feed is arranged to be at the open end of the PILA 1, where for a conventional feed the impedance would be very high and the antenna would be difficult to feed.

The PILA 1 is bifurcated with two arms 2, 3 of different lengths. The elongated dielectric ceramic pellet 5 acts as a feed and effective drive for both arms 2, 3 of the PILA 1, driving each at the appropriate frequency.

Figure 2:
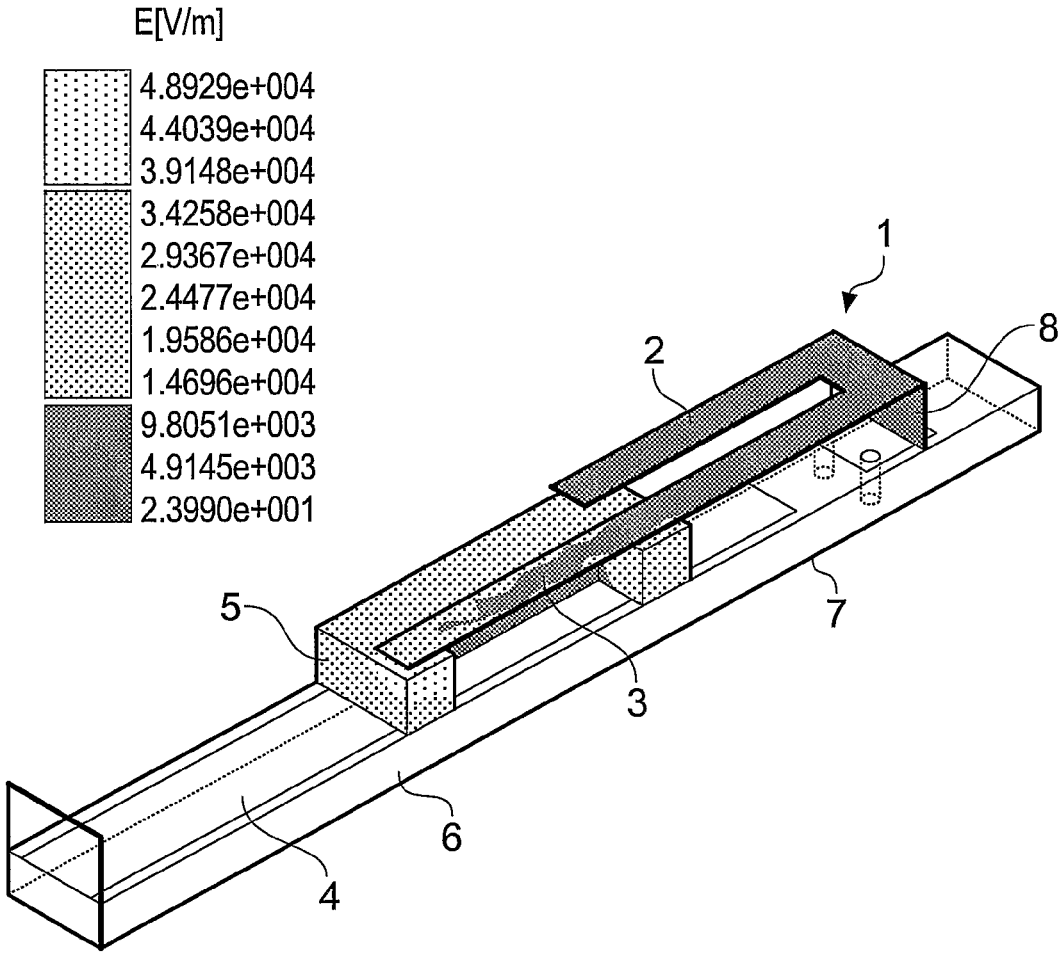
FIG. 2 shows an E-field plot of the antenna of FIG. 1 at the 2.4 GHz band.
Figure 3:
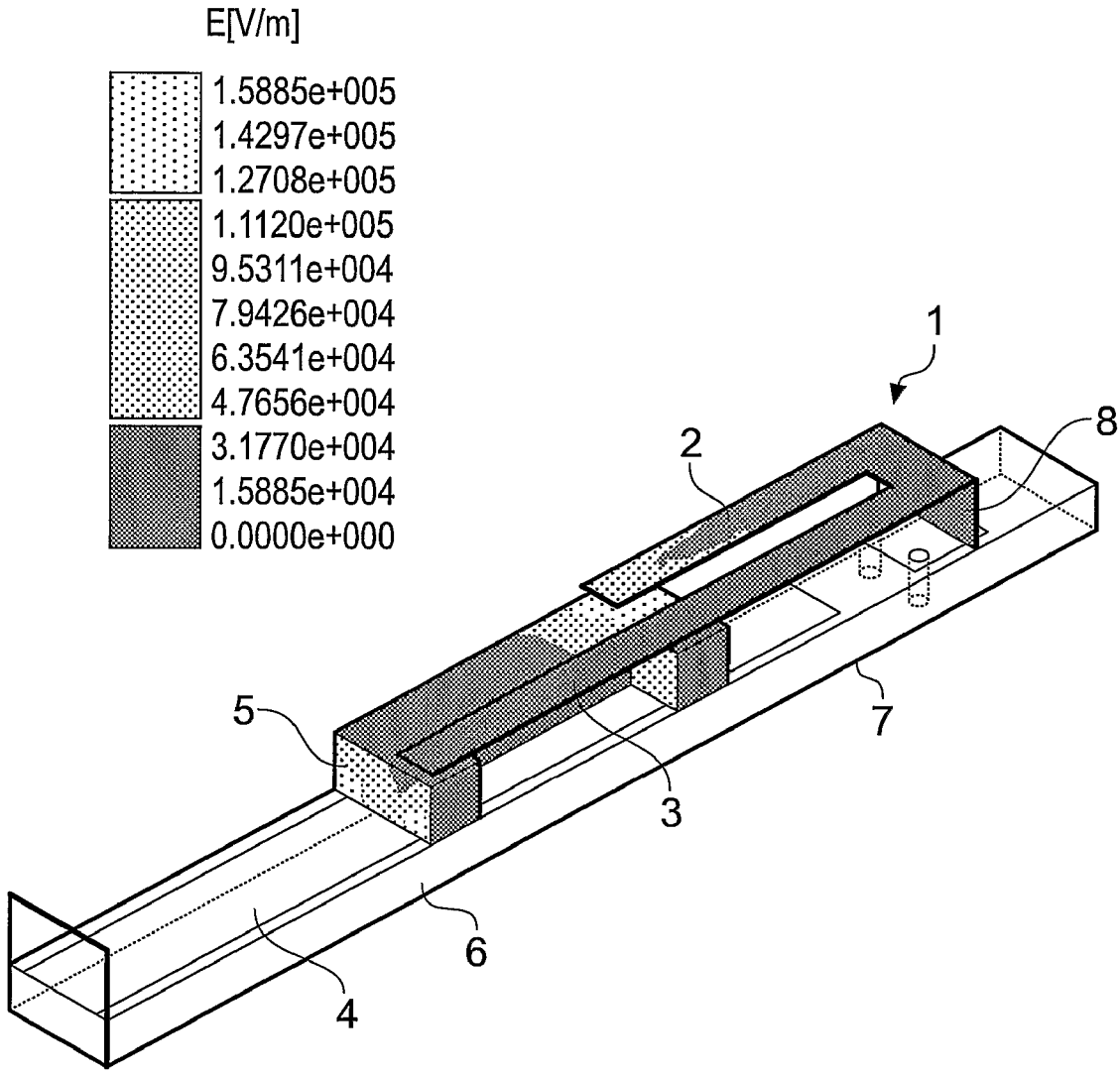
FIG. 3 shows an E-field plot of the antenna of FIG. 1 at the 5.5 GHz band.

Simulated Results:

Initial development of the antenna was carried out using the Ansoft® 3D electromagnetic simulator, HFSS. The computer simulation results showed good return loss at the desired frequency bands. The simulation also confirmed the effective and independent operation of the two sections 2, 3 of the radiating element 1 and allowed the optimisation of the size, shape and permittivity of the ceramic pellet 5. FIG. 2 shows the expected electric field distribution at the middle of the lower 2.4 GHz frequency band, with the electric field being strongest at the end of the longer arm 3 of the radiating element 1. FIG. 3 shows the expected electric field distribution at the middle of the upper 5.5 GHz frequency band, with the electric field being strongest at the end of the shorter arm 2 of the radiating element 1.

Figure 4:
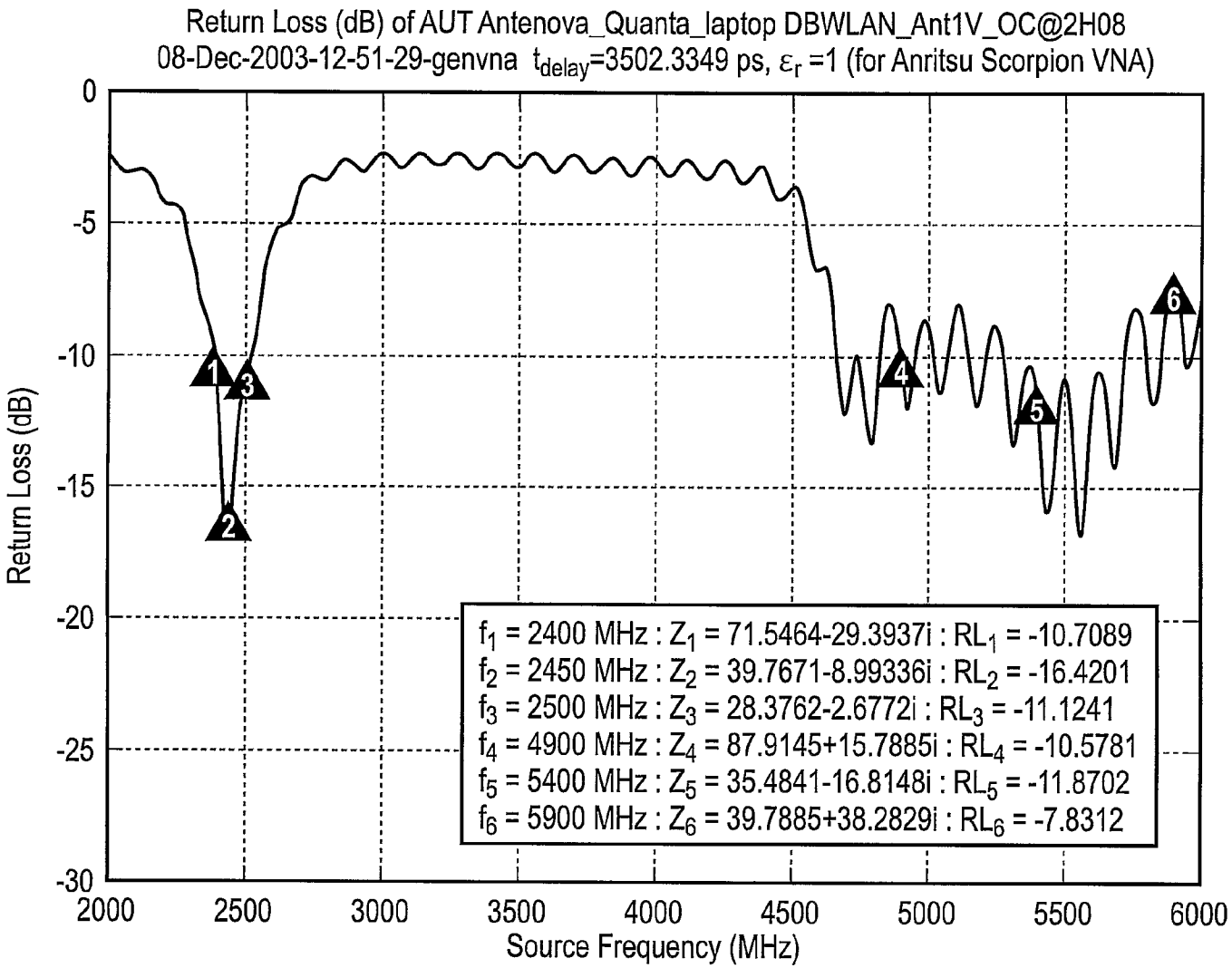
FIG. 4 shows a measured return loss plot of the antenna of FIG. 1.

Measured Results:

The measured input return loss of the complete antenna and its feed cable is shown in FIG. 4. The small ripples in the measurement are caused by a mismatch at the measurement point, a familiar problem when working with subminiature cables at high frequencies.

It can be seen that the design has been configured to provide a much wider bandwidth at 5 GHz than at 2.5 GHz, corresponding to the desired requirement of the antenna. In a practical application, compensating the connector discontinuity within the connected device can reduce the input-end mismatch and corresponding ripple, allowing the target return loss of 10 dB to be achieved across both bands.

Figure 5:
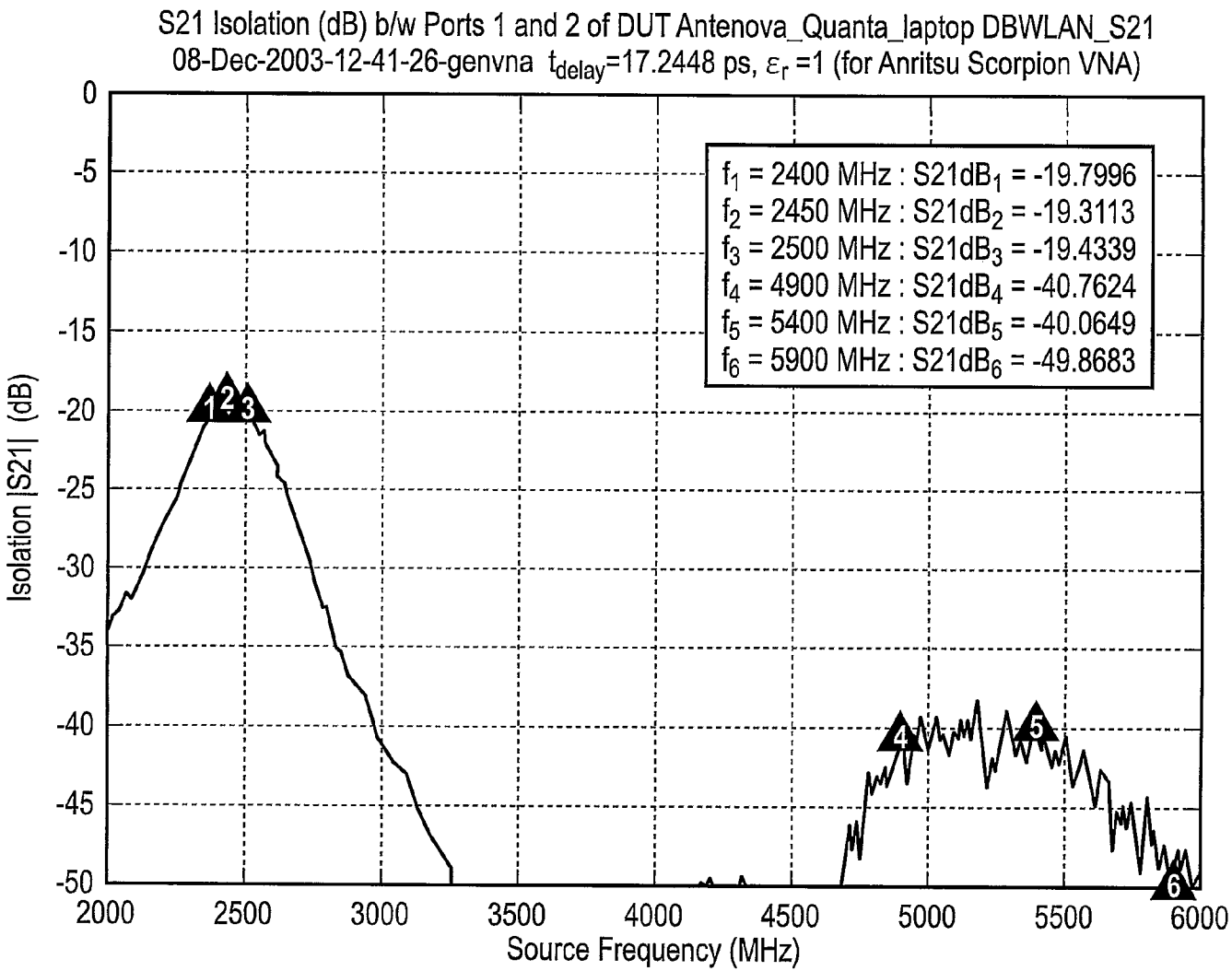
FIG. 5 shows a plot of isolation between a pair of antennas of FIG. 1.

To investigate isolation performance, a pair of antennas was mounted in a typical laptop application on the top of the display with a spacing of 75 mm between the antennas. It can be seen from FIG. 5 that the isolation between the antennas is around 20 dB in the low band (where the antennas are electrically closer together) and 40 dB in the high band.

The preferred features of the invention are applicable to all aspects of the invention and may be used in any possible combination.

Throughout the description and claims of this specification, the words "comprise" and "contain" and variations of the words, for example "comprising" and "comprises", mean "including but not limited to", and are not intended to (and do not) exclude other components, integers, moieties, additives or steps.

The invention claimed is:

1. A dual band antenna device comprising:

a dielectric substrate comprising opposed first and second surfaces;

a groundplane disposed on the second surface;

a microstrip transmission line disposed on the first surface;

a dielectric pellet mounted on the first surface on the microstrip transmission line; and a bifurcated planar inverted-L antenna (PILA) component mounted on the first surface, wherein the PILA component is electrically connected to the groundplane and comprises first and second arms which extend over and contact a surface of the dielectric pellet, wherein the first arm contacts a different area of the surface of the dielectric pellet than the second arm.

2. The device of claim 1, wherein the dielectric pellet comprises a high permittivity ceramics material.

3. The device of claim 1, wherein the dielectric pellet comprises an elongate structure with a generally flat exposed surface facing away from the first surface of the dielectric substrate.

4. The device of claim 3, wherein the dielectric pellet comprises a bridge structure comprising first and second feet that contact the microstrip transmission line.

5. The device of claim 3, wherein the bifurcated PILA is disposed in line with the elongate dielectric pellet, and wherein the first arm of the PILA extends across and contacts substantially a full length of the exposed surface of the dielectric pellet, while the second arm of the PILA is shorter than the first arm and contacts a smaller part of the exposed surface of the dielectric pellet.

6. The device of claim 1, configured for operation in a first frequency band of 2.4 to 2.5 GHz and a second frequency band of 4.9 to 5.9 GHz.

7. A dual band antenna device comprising:

a dielectric substrate comprising opposed first and second surfaces;

a groundplane disposed on the second surface;

a bifurcated planar inverted-L antenna (PILA) component mounted on the first surface and electrically connected to the groundplane, wherein the PILA component is electrically connected to the groundplane and comprises first and second electrically connected arms; and a dielectric pellet comprising a surface connected to the first and second arms, wherein the dielectric substrate includes an aperture that is disposed beneath the dielectric pellet, wherein the pellet is connected to a coaxial feed line, and wherein the first arm of the PILA component contacts a different area of the surface of the dielectric pellet than the second arm.

* * * * *